United States Patent [19]

Nelson et al.

[11] 4,341,018

[45] Jul. 27, 1982

[54] WORK LENGTH GAUGE ATTACHMENT FOR CHAIN SAWS

[76] Inventors: James F. Nelson, 263 Euclid Ave., Kenmore, N.Y. 14217; Robert W. Nelson, 36 Lake Ave., Lancaster, N.Y. 14086

[21] Appl. No.: 166,542

[22] Filed: Jul. 7, 1980

[51] Int. Cl.[3] ..... B27B 17/00

[52] U.S. Cl. ..... 30/383; 403/391

[58] Field of Search ..... 30/381, 382, 383, 384, 30/233, 166 R, 371, 373, 374; 403/389, 391, 385

[56] References Cited

U.S. PATENT DOCUMENTS

| | | | |
|---|---|---|---|
| 1,166,688 | 1/1916 | Hornby | 403/391 X |
| 1,446,380 | 2/1923 | De Laney | 30/233 |
| 2,807,292 | 9/1957 | Gelinas | 30/383 |
| 3,195,938 | 7/1965 | Rifken | 403/385 X |
| 3,677,584 | 7/1972 | Short | 403/389 |
| 4,233,739 | 11/1980 | Hinrichs | 30/383 |

FOREIGN PATENT DOCUMENTS

| | | | |
|---|---|---|---|
| 403549 | 6/1966 | Fed. Rep. of Germany | 30/233 |

*Primary Examiner*—Jimmy C. Peters

*Attorney, Agent, or Firm*—Raymond F. Kramer

[57] ABSTRACT

An attachment for a chain saw, suitable for holding a work length gauge, such as a wire log length gauge, to the chain saw so as to facilitate measuring and cutting logs to equal length, is provided for fastening to different handles and/or handle portions of different types of chain saws and for holding the gauge in desired gauging position with respect to the saw chains and cuts. The attachment is adapted to be fastened to vertical, horizontal transverse and horizontal longitudinal handle portions and to hold the log length gauge so that it may extend horizontally and transversely with respect to the chain. Positioning of the attachment on the saw may be effected by removing or loosening the saw handle and sliding the attachment onto it and then refastening the handle. In a preferred embodiment of the invention the attachment may be fastened to the saw handle without the need for loosening or removing the handle.

5 Claims, 3 Drawing Figures

WORK LENGTH GAUGE ATTACHMENT FOR CHAIN SAWS

Figure 1:
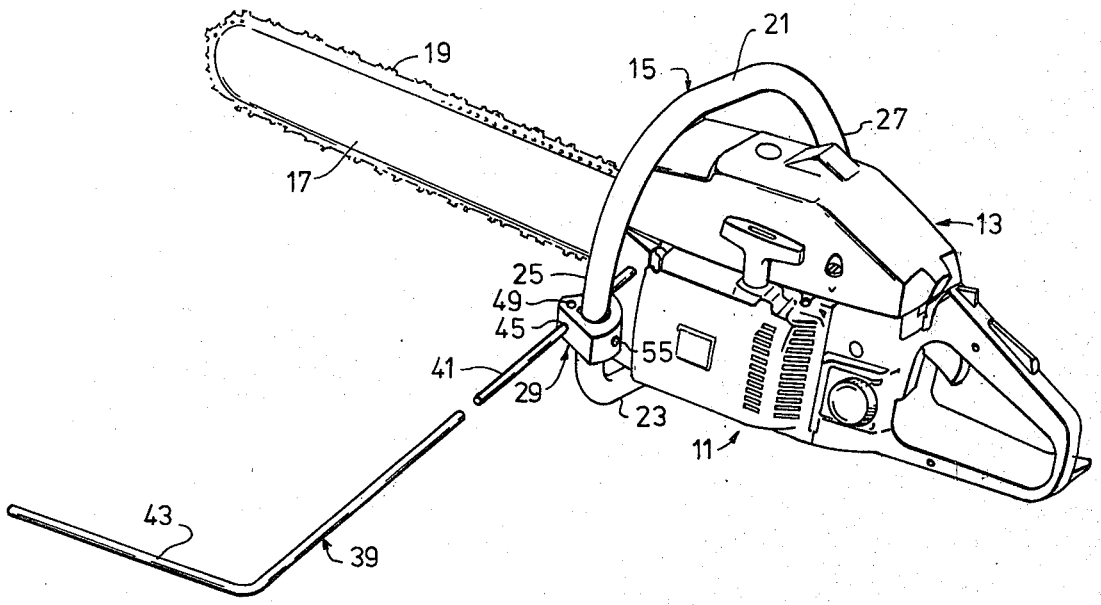

This invention relates to a work length gauge attachment for chain saws. More particularly, it relates to such an attachment for holding a work length gauge, such as a wire log length gauge, in desired gauging position with respect to the cutting chain of the saw, so as to facilitate cuttings logs to uniform desired lengths.

Portable chain saws, powered by gasoline engines or electric motors, have recently become increasingly useful as means for cutting tree trunks and branches into logs of desired lengths, suitable for stacking and for burning in fireplaces or stoves of particular sizes. Clearly, correctly sized logs will better fit particular fireplaces or stoves, will be more attractive in such fireplaces, and will promote more efficient burning in such stoves, thereby helping to conserve energy. They also may be more readily stacked and more efficiently transported. Accordingly, gauges have long been employed to measure tree portion lengths so that the logs produced will be more uniform. Rulers, tape measures and yardsticks have been used, and once the right length has been determined a cut log may be employed. However, extra operations are involved in positioning such separate measuring means and in marking the tree part for cutting. Additionally, one-handed positioning of the chain saw to make the marking cut can be dangerous and such positioning may be necessitated because the other hand of the saw user would be holding the log marking or measuring implement. For safety's sake and to facilitate more rapid and efficient cutting of logs to uniform length, gauges have been fastened to chain saws and attachments have been made for holding such gauges in desired position on power saws. However, prior to the present invention no attachments were known which would allow holding of a work length gauge like that used with the present attachment in desired position on differently oriented chain saw handles or portions of such handles. The present attachment is easy to install and to relocate on a chain saw handle and allows easy changing in position of the work gauge for the convenience of the saw operator.

In accordance with the present invention a gauge attachment for a chain saw, suitable for attachment to differently positioned handles of different types of chain saws and to different portions of chain saw handles, comprises a body portion capable of being fastened to such different handles and handle portions in different relative positions, means for holding a work length gauge in gauging position when the attachment is held to one such handle or handle portion and means, different at least in part, for holding the gauge in gauging position when the attachment is held in a different relative position on a different type of handle or handle portion. In preferred embodiments of the invention the attachment is made of elastomeric or synthetic organic polymeric material, is fastenable to horizontal or vertical portions of chain saw handles and is adapted to hold a wire log length gauge in position transverse to the cutting plane of the saw by means of a set screw which presses the gauge against an appropriate aligning passagway wall in the attachment. It is also preferred that the attachment be of teardrop-type shape, with a corresponding opening therein to accommodate the chain saw handle, a holding set screw at the rounded wider portion of the attachment and the gauge holding means of the attachment at the narrower or pointed part thereof. Also, to facilitate easier installation and removal of the attachment, it may be made openable so that it can be installed on a chain saw handle without first disconnecting a portion of the saw handle from the saw.

A search of the prior art, covering subclasses 30-123, 30-371, 30-373, 30-381, 30-383, 33-202 and 83-703, resulted in the finding of U.S. Pat. Nos. 2,765,007; 2,807,292; 3,276,490; 3,364,580; 3,531,870; and 4,185,382. All such patents illustrate log length gauges held to chain saws and extending transversely from the cutting planes thereof. However, only one such gauge, that of U.S. Pat. No. 2,807,292, referred to by the patentee as a folding rule, is fastened to a saw handle part. The patent does not describe or suggest positioning of an attachment on different parts of a chain saw handle, does not describe or suggest the present simple and inexpensive attachment or an equivalent and does not make the present invention obvious. The various other patents mentioned illustrate attachments of log gauges to saw frames, for the most part, with U.S. Pat. No. 4,185,382 showing attachment to a stud bolt used to hold saw parts together. In U.S. Pat. No. 2,765,007 a gauge is held to a bracket which is taught to be attached to the saw frame. Even if that saw frame portion is considered to be similar to a handle, the attachment is clearly structurally and functionally distinguishable from that of the present invention.

Figure 2:
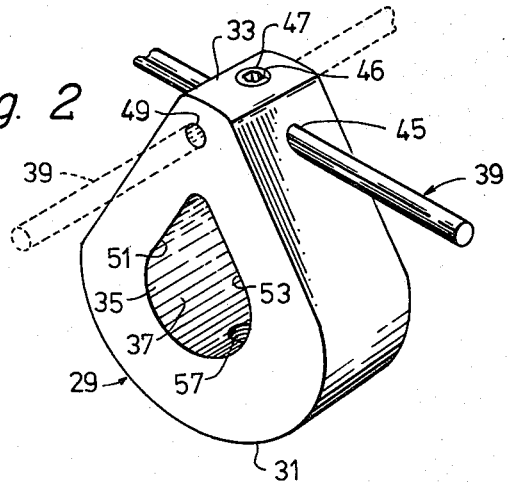
Figure 3:
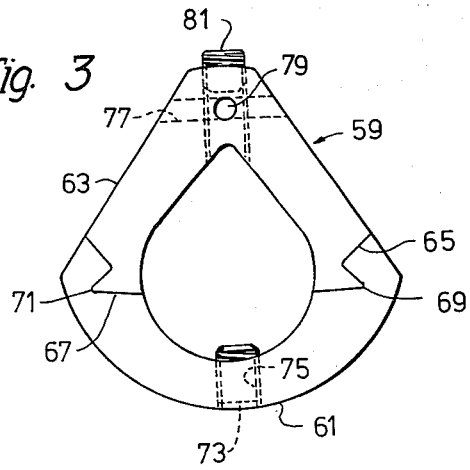

The invention will be readily understood by reference to this specification, including the following description, taken in conjunction with the drawing, in which:

FIG. 1 is a perspective view of a chain saw having an attachment of this invention installed thereon, holding a wire log measuring gauge in desired log length gauging position;

FIG. 2 is an enlarged perspective view of the attachment of FIG. 1, showing a portion of the log length gauge in the position shown in FIG. 1 and a portion of such gauge, in phantom lines, in alternative log length measuring position thereof, where it may be held when the attachment is fastened to the top of the saw handle; and FIG. 3 is a top plan view (considering prospective installation to be like that of FIG. 1) of a modification of the attachment of the invention to facilitate ready installation thereof.

Referring to FIG. 1, chain saw 11, of the gasoline engine driven type, includes a frame 13, a supporting handle 15, a guide bar 17 and a saw chain 19. The chain saw also includes other normal components, including throttle, starter, rear or balancing handle, gasoline engine, engine lubricating system, electrical system, exhaust system and chain lubricator. Some such are illustrated but it is not considered to be necessary to identify them in the drawing with numerals. Also, it is preferred that a chain brake or kick-back guard, not shown, be present on the saw. Main handle 15, shown in the form of a curved tube, as illustrated, has portions which are substantially horizontal and others which are or substantially vertical and it is onto such portions, whether at the top 21, bottom 23 or sides 25 and 27 of the handle, to which attachment 29, shown installed on the left vertical portion 25 of the handle, may be held.

The invented attachment, which is preferably made of elastomeric material or of a synthetic organic polymer, is of what may be described as a teardrop type shape, as is also shown in FIG. 2, with a larger curved or rounded wall 31 at one end and a pointed, rounded point or flat point end 33 at an opposite end. As shown, it has a correspondingly teardrop shaped opening 35 therein having an internal wall 37. Wire log gauge 39, having a main portion 41 extending along the work to be cut and a bent end portion 43 to hold at an end of a log to be cut, is held to attachment 29 by being passed through a similarly sized cylindrically shaped passageway or hole 45 therein and being pressed against a wall portion of said passageway, in the case illustrated the near wall (with reference to FIG. 1), by tightening of a set screw 47, which is threaded into a corresponding threaded opening in the "pointed" end of attachment 29. For installation of log gauge 39 in the same generally extending transverse position, with respect to the cutting plane of the chain saw (or longitudinal position, with respect to the log to be cut), when the attachment is to be fitted to the top portion 21 of handle 15 the log gauge wire will be inserted in correspondingly sized opening 49 and will be tightened in place by adjustment of set screw 47. It is noted that, as illustrated, openings 45 and 49 are coplanar or substantially coplanar, at 90°, and intersect under opening 46, in which set screw 47 is positioned. Thus, a single set screw is capable of tightening the log gauge in place against the walls of either passageway 45 or passageway 49. It will be seen that when the attachment is to be fastened to main chain saw handles of different types than that illustrated in FIG. 1, with a portion thereof extending substantially horizontally and in the direction of the chain saw cutting plane, log gauge 39 may be inserted through opening 45, as shown in FIGS. 1 and 2, in which case only turning of the gauge will be desirable, preferably rotation for 90°, so that end 43 of the gauge may better approach the end of a log to be cut.

Attachment 29 is held to handle 15, which handle is usually essentially circular in cross-section but needs not be, by being pressed against "teardrop" tapered walls 51 and 53 by the tightening of set screw 55, shown in FIG. 1, as it is advanced through threaded walled opening 57, illustrated in FIG. 2. In effect, the particular shape utilized for the opening in the attachment facilitates firm holding of the attachment to handles of different cross-sectional shapes and especially to those which are rounded, because these often difficultly held parts are forced against and held to the converging, essentially flat walls of the "top" of the teardrop by the tightening of set screw 55. Of course, as is illustrated, it is preferable that the set screw be centrally positioned between the sides of the attachment and in alignment with the pointed end thereof. This helps to prevent rocking of the attachment with respect to the handle and facilitates steady holding of the log length gauge in desired position.

In FIG. 3 there is depicted attachment 59 which is made of two parts, rounded lower part 61 and essentially triangularly shaped upper part 63. These are fitted together along interfitting surfaces of joinder 65 and 67 (single numerals identifying two matching surfaces) and are held together by undercuts of both parts. For example, part 61 is undercut at 69 and 71. After sliding the parts together about an appropriate handle part or portion, tightening of a set screw 73 in threaded opening 75 against an enclosed handle (not shown in FIG. 3) makes sliding apart of the parts difficult, thereby holding parts 61 and 63 so that they fit tightly together, in interlocking relationship. At the top of the attachment, as shown in FIG. 3, there are provided walled passageways 77 and 79, similar to passageways 45 and 49 of FIGS. 1 and 2, adapted to hold a log length gauge like that shown at 39 of FIGS. 1 and 2 in desired position against an appropriate passageway wall when set screw 81 is tightened against the gauge.

It is a simple matter to utilize the attachment of the present invention. First, a suitably sized attachment is selected so that it will fit the handle of the chain saw to be employed. The handle is removed from the saw body or frame or is suitably loosened so that the attachment can be slipped over an end portion thereof. The shape of the attachment and, when it is elastic, the resiliency thereof, help to make installation easy. The handle is next reattached to the chain saw body and the attachment is slid into desired position. The work length gauge is then inserted into the proper opening of the corresponding shape in the attachment, the attachment is moved into final position and the appropriate set screws or other fasteners are tightened, fastening the attachment in place on the handle and the gauge in place with respect to the attachment. Prior to such final fastening the bent end of the gauge may be rotated to the most desirable position, which can be vertical, horizontal or inclined, as is best suited to the circumstances. The gauge may be installed so as to extend to the right or left side of the saw, as preferred by the operator. In cases wherein the handle design is such that it is not readily possible to install the attachment on a vertically extending portion of the handle on either side thereof, one may install it at the top and in some cases, at a bottom portion of the handle. Such installations may also be favored when the length of the gauge is such that it cannot be shortened to desired length without an end thereof hitting the saw body in normal installation position on a vertical portion of the handle.

After installation is effected it is a simple matter to move the work piece into position, gauge off the length of a log and make the appropriate cut thereof. To change the gauge length the appropriate set screw is loosened, the length is readjusted and the screw is retightened. Because the attachment is adaptable to use on a wide variety of chain saw models it is a simple matter to remove it from one and install it on another, in appropriate orientation. When not in use the gauge is preferably removed from the attachment, especially if the attachment is to remain on the saw in the position indicated in FIG. 1, but in some instances it may be stored on the attachment and the attachment may remain on the saw handle but preferably will be moved into such a position that the teardrop is oriented vertically and the gauge is aligned with the saw chain. In such position there is less chance of the gauge being bent due to contact with external objects and the chain saw will take less room for storage.

The materials of construction of the attachment will normally be those which are readily available and comparatively inexpensive. Synthetic organic polymers, such as nylons, acrylonitrile-butadiene-styrenes, polyacetals, fiber reinforced polymers, such as fiberglass reinforced polyesters and fiberglass reinforced polyethers, polyolefins, especially polypropylenes, polyacrylates, e.g., polymethylmethacrylate, polystyrenes, polyurethanes and cellulose derivatives may be employed, some of which may be resilient or elastomeric and others of which may be essentially inelastic and non-yielding. Also useful are elastomeric and firm natural rubbers, including hard rubbers, and synthetic rubbers, e.g., neoprenes. In some instances metals or woods and other naturally occurring materials may be substituted. In those cases wherein the mentioned materials are not readily threadable, sleeves or inserts of other suitable components may be utilized. Sometimes the attachment may be entirely or partially composed of a suitable metal, such as aluminum or copper or a metallic alloy, such as steel, stainless steel, magnesium-aluminum alloy or brass may be utilized. Usually the gauge will be of a metal but form retaining synthetic organic polymers and natural materials, such as woods, and other cellulosic substances, may also be employed. The various set screws are usually of metal but can also be of polymeric material (plastic).

The dimensions of the attachment will be chosen so as to fit various chain saw handles and gauges to be used therewith, and to provide sufficient holding length so as to steadily support the gauge utilized. For example, an appropriately sized attachment may often be from 5 to 7 cm. in both major dimensions and from 1.7 to 3 cm. wide, with the opening therein for the handle being from 3 to 4 cm. across, in both major dimensions. In the preferred teardrop shapes of the attachment and the included opening, the apex angle of the converging or isosceles triangle walls will usually be in the range of 50° to 100°, preferably 60° to 90°. Usually the gauge will be from 2 to 5 mm. in diameter (or across) and will be 0.5 to 2 meters, preferably 0.7 to 1.5 m. long. The passageway for accommodating the gauge will be similarly cross-sectionally shaped and sized.

Many variations of the attachments described and illustrated may also be employed and some of these will now be mentioned. While the described teardrop shape of the attachment is highly preferred, various other shapes may also be utilized, especially with respect to the outer configuration of the attachment. Instead of utilizing screws for holding items in place other attachment means may be employed, including clamps (of hose clamp or other suitable types), U-clamps, sheet metal, machine or wood screws for fastening into or through the material of the handle, cord, wire, tape, and hook and loop fastening means, e.g., VELCRO. When elastomers are utilized as the materials of construction of the attachment the natural resiliency thereof may provide sufficient holding force to maintain the attachment on the handle in proper position and also, in some cases, to hold the gauge.

In variations of the embodiment of the invention illustrated in FIG. 3 other means for fitting and holding the attachment onto the saw handle may be employed, such as hinge and lock devices, including molded-in hinge and lock means, screws, nuts and bolts, toggles, clamps and ties for releasably holding different parts or adjoining ends of the same parts together. The gauges may be made of rods or tubes, as well as of wires and they may be extendable or telescoping so that they may be adjusted to the desired gauging length without the need for moving an end portion thereof nearer to the saw chain or the chain saw frame or body. If desired the saw handle may be appropriately marked or otherwise altered to indicate proper locations for installations of the invented attachments and may be adapted to hold the attachments better in desired position, as by undercutting the appropriate handle portions or making holes or depressions therein to accommodate the set screws or other holding means.

Important among the advantages of the invention are its simplicity, economy, unobtrusiveness, safety and excellent performance on the job. It may be installed on a chain saw handle and may be left there for future use with the gauge, when desired, without interfering with normal use of the chain saw. The attachment is useful with many types of chain saws and may be attached to different portions of the handles of such chain saws. It is employable by both right and left handed operators of chain saws and the gauges held by it may extend to either the right or left of the saw's cutting plane. Despite the wide variety of chain saw handle designs the versatility of the present attachment makes it applicable to various such designs and to most desired positionings with respect to the various chain saw handles normally encountered. The unobtrusiveness of the attachment allows it to be permanently or semi-permanently installed on a chain saw handle so that it does not interfere with normal chain saw use when the gauge is not employed and yet is always available for gauging applications. In short, the invention is of a simple, economical, easy to use and effective product which is superior in a wide variety of applications to other gauges previously suggested for employment with chain saws. The invented attachments are economical, effective, easy to use, hard to lose and promote safe operation of chain saws. As such, they represent a significant advance in this area of chain saw devices.

The invention has been described with respect to various illustrations and embodiments thereof but is not to be limited to these because it is evident that one of skill in the art, with access to the present specification, will be able to utilize equivalents and substitutes without departing from the invention.

What is claimed is:

1. A gauge attachment for a chain saw, suitable for attachment to transverse, vertical and longitudinal handles or handle portions of chain saws and to which a work length gauge which is a rod, tube or wire is fastenable in such position that with respect to such chain saw handles or portions thereof, when the attachment is attached thereto and the gauge is fastened to it, the gauge extends transversely with respect to the saw chain, which comprises a body portion which includes a substantially teardrop shaped opening through it, rounded on one end and converging toward a point at the other end, with a threaded opening at the rounded end to accommodate a set screw, a set screw for screwing into said opening to bear against a chain saw handle or handle portion so as to hold the attachment in desired position thereon, a plurality of openings in the attachment body suitable for selective insertion of the work length gauge and for holding it in desired gauging position, said openings being walled passageways through the body portion of the article, and having threaded portions coplanar and intersecting at right angles, and set screws for screwing in the threaded passageway portions for holding the gauge in place in one of such passageways when the corresponding screw is tightened.

2. A gauge attachment according to claim 1 wherein the body portion of the attachment is substantially of teardrop shape, corresponding to the shape of the internal opening therein, rounded at one end and converging toward the other end, with the passageways for selective insertion of the gauge and the set screws for holding the gauge in place being located at the end of the attachment away from the rounded end thereof.

3. A gauge attachment according to claim 2 wherein the body portion is of a rigid synthetic organic polymeric material.

4. A gauge attachment for a chain saw, suitable for attachment to transverse, vertical and longitudinal handles or handle portions of chain saws and to which a work length gauge which is a rod, tube or wire is fastenable in such position that with respect to such chain saw handles or portions thereof, when that attachment is attached thereto and the gauge is fastened to it, the gauge extends transversely with respect to the saw chain, which comprises a body portion which includes a teardrop shaped opening through it, rounded at one end and converging toward a point at the other end, with a threaded opening at the rounded end to accommodate a set screw, a set screw for screwing into said opening to bear against a chain saw handle or handle portion so as to hold the attachment in desired position thereon, a plurality of openings in the attachment body suitable for selective insertion of the work length gauge and for holding it in desired gauging position, said openings being walled passageways through the body portion of the article and having threaded portions, which openings and the threaded portions thereof are at about right angles to each other, and set screws for screwing in the threaded passageway portions for holding the gauge in place in one of such passageways when the corresponding screw is tightened.

5. A gauge attachment according to claim 4 wherein the body portion of the attachment is substantially of teardrop shape, corresponding to the shape of the internal opening therein, rounded at one end and converging toward the other end, with the passageways for selective insertion of the gauge and the set screws for holding the gauge in place being located at the end of the attachment away from the rounded end thereof.

* * * * *